US006634444B2

(12) United States Patent
Fuller et al.

(10) Patent No.: US 6,634,444 B2
(45) Date of Patent: Oct. 21, 2003

(54) DRILL BIT FOR TRENCHLESS DRILLING

(75) Inventors: Gary A. Fuller, Abingdon, VA (US); Kenneth Monyak, Abingdon, VA (US); Thomas J. Maechler, Indian Trail, NC (US)

(73) Assignee: Sandvik Rock Tools, Inc., Bristol, VA (US)

( * ) Notice: Subject to any disclaimer, the term of this patent is extended or adjusted under 35 U.S.C. 154(b) by 44 days.

(21) Appl. No.: 10/058,389

(22) Filed: Jan. 30, 2002

(65) Prior Publication Data

US 2003/0141114 A1 Jul. 31, 2003

(51) Int. Cl.[7] ..... E21B 7/08; E21B 10/00

(52) U.S. Cl. ..... 175/401; 175/398; 175/327; 175/61

(58) Field of Search ..... 175/401, 385, 175/398, 327, 19, 61, 73

(56) References Cited

U.S. PATENT DOCUMENTS 1,504,852 A * 8/1924 Wright ..... 175/385
4,187,626 A * 2/1980 Greer et al. ..... 37/453
4,953,638 A 9/1990 Dunn
5,242,026 A * 9/1993 Deken et al. ..... 175/62
5,647,448 A 7/1997 Skaggs
6,026,916 A * 2/2000 Briese ..... 175/336
6,125,950 A * 10/2000 Osborne ..... 175/73
6,154,987 A * 12/2000 Rumer et al. ..... 37/352
6,247,544 B1 6/2001 Beebe
6,260,634 B1 * 7/2001 Wentworth et al. ..... 175/61

* cited by examiner

*Primary Examiner*—David Bagnell
*Assistant Examiner*—T Shane Bomar
(74) *Attorney, Agent, or Firm*—Burns, Doane, Swecker & Mathis, LLP

(57) ABSTRACT

A drill bit for trenchless drilling includes a bit body defining a longitudinal axis about which the drill bit is rotated during a trenchless drilling operation. Two sets of cutting teeth are mounted at a front end of the bit body, the sets disposed on opposite sides of the axis. The first and second sets are brazed into respective slots formed in the first and second side surfaces of the bit body. The slots on each side surface communicate with a common groove, wherein the groove forms a shoulder against which rear ends of the cutting teeth abut.

7 Claims, 2 Drawing Sheets

DRILL BIT FOR TRENCHLESS DRILLING

BACKGROUND OF THE INVENTION

The present invention relates to horizontal directional drilling, also known as trenchless drilling and, in particular to a drill bit component of an apparatus used for such drilling.

Horizontal directional drilling techniques have been used to drill boreholes generally horizontally beneath structures such as roadways or obstructions that are not to be disturbed. Such boreholes can be used to enable objects such as cables, pipelines etc. to be passed beneath the roadway without damaging the roadway or interrupting travel thereon.

Apparatus for performing such drilling is described for example in U.S. Pat. No. 4,953,638, and depicted herein schematically in FIG. 8. The apparatus includes a machine 10 disposed on one side of a structure, such as a roadway 12 beneath which a borehole 14 is to be drilled. The machine supports and rotates a rear end of an elongated drill string 16 which comprises a series of interconnected pipes and a drill bit 18 mounted at the front end of a forward-most pipe. The rear end of the drill string is rotated, causing the drill bit to cut through the soil. Simultaneously, the drill string is advanced in a generally horizontal direction. Periodically, the drilling is stopped to enable a new section of pipe to be attached to the rear of the drill string. Eventually, the drill bit 18 emerges through the soil at the other side of the roadway to completed the borehole. Then, a cable, pipeline, etc, can be inserted through the borehole.

The drill bit can assume different configurations, such disclosed in U.S. Pat. Nos. 5,647,448 and 6,247,544, for instance. In U.S. Pat. No. 5,647,448 a duckbill-shaped drill bit for trenchless drilling is disclosed which comprises a bit body having a plurality of teeth mounted therein. The teeth are in the form of carbide tips mounted in a front free end of the bit body. First and second sets of teeth are disposed on respective sides of a longitudinal center axis of rotation of the bit body. The teeth of the first set are oriented asymmetrically with respect to the teeth of the second set with reference to the axis, whereby the teeth of each set do not precisely track the teeth of the other set as they break through hard materials such as rock. Each tooth has a rear end that is mounted in a respective pocket (hole) drilled into the bit body.

The drill bit disclosed in U.S. Pat. No. 6,247,544 includes a bit body having a series of notches cut into a front end thereof. Cutting teeth are welded to respective notches. Each tooth comprises a carbide tip mounted on a steel tooth body (i.e., a composite arrangement), the steel body being required in order to be weldable to the steel bit body. A shortcoming of such an arrangement is that the teeth have backsides (considered with reference to the direction of rotation) which are unsupported by the bit body (unlike the teeth of U.S. Pat. No. 5,647,448 wherein the teeth are mounted in pockets (holes). Thus, not only are the composite teeth of U.S. Pat. No. 6,247,544 more expensive to manufacture (due to the need to bond a carbide tip to a separate steel tooth body), they can tend to break off if the shear forces overcome the weld forces.

Accordingly, it would be desirable to provide a novel drill bit for trenchless drilling which utilizes teeth that: do not have to be in the form of composites, do not require the drilling of holes into the bit body, and are supported at their backsides.

SUMMARY OF THE INVENTION

The present invention relates to a drill bit for trenchless drilling. The drill bit comprises a generally flat bit body which includes first and second side surfaces that are separated from one another by a thickness of the bit body. The bit body further includes a front cutting end and a rear mounting end adapted to be mounted to a rotary drill string. The bit body defines a longitudinal center axis extending through the mounting end and the cutting end. The cutting end includes a front edge, and first and second grooves formed in the first and second side surfaces, respectively. Each groove defines a generally forwardly facing shoulder spaced rearwardly from the front edge and being exposed to the front edge by a plurality of slots formed in the respective first and second side surfaces. Each slot extends from the front edge to a respective groove in a direction oriented generally radially with reference to the front edge. The slots associated with each groove are spaced apart from one another along the front edge by lands formed by the bit body. Each land includes a rear end spaced forwardly from and facing the respective shoulder. The grooves and the slots extend only partially through the thickness of the bit body from the respective first and second side surfaces, wherein the bit body defines a floor extending from each shoulder to the front edge. First and second sets of cutting teeth are mounted to respective ones of the first and second side surfaces and are disposed on opposite sides of the axis. Each tooth includes a front cutting end, a rear mounting portion mounted in a respective one of the slots. Each mounting portion rests upon the floor associated with the respective slot, and a rear end of each tooth abuts against a respective one of the shoulders. The first set of teeth is arranged asymmetrically relative to the second set of teeth with reference to the axis.

Preferably, the front edge is convexly curved, and the shoulder is convexly curved correspondingly to the curvature of the front edge.

The present invention also relates to a method of manufacturing a drill bit for trenchless drilling. The method comprises the steps of:

(A) providing a bit body having first and second side surfaces, a rear mounting end, and a front cutting end, and defining a longitudinal center axis extending from the mounting end to the cutting end;

(B) milling a groove into the first side surface of the bit body, wherein the groove is spaced rearwardly from a front edge from the bit body and forms a forwardly facing shoulder;

(C) milling a plurality of slots in the first side surface, wherein each slot extends from the front edge to the groove in a direction generally radially with reference to the front edge, the slots are spaced apart along the front edge, wherein the bit body forms lands disposed between adjacent slots, each land including a rear end spaced forwardly from and facing the shoulder, the slots and the groove forming a floor extending from the front edge to the shoulder;

(D) positioning cutting teeth in respective ones of the slots such that each tooth includes a front cutting portion, and a rear end abutting the shoulder;

(E) securing the teeth to the bit body; and (F) performing steps A–D with respect to the second side surface, wherein the teeth associated with the first side surface define a first set of teeth disposed on a first side of the axis, and the teeth associated with the second side surface define a second set of teeth disposed on a second side of the axis, the first set of teeth arranged asymmetrically relative to the second set of teeth with reference to the axis.

BRIEF DESCRIPTION OF THE DRAWINGS

The objects and advantages of the invention will become apparent from the following detailed description of preferred embodiments thereof in connection with the accompanying drawings in which like numerals designate like elements.

DETAILED DESCRIPTION OF A PREFERRED EMBODIMENT OF THE INVENTION

Figure 1:
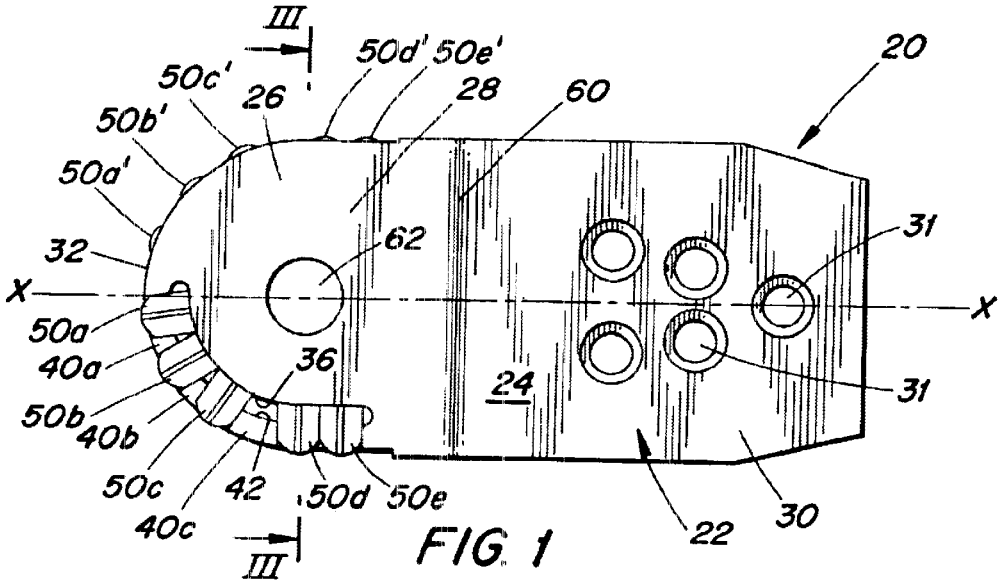
FIG. 1 is a top plan view of a drill bit according to the present invention.
Figure 2:
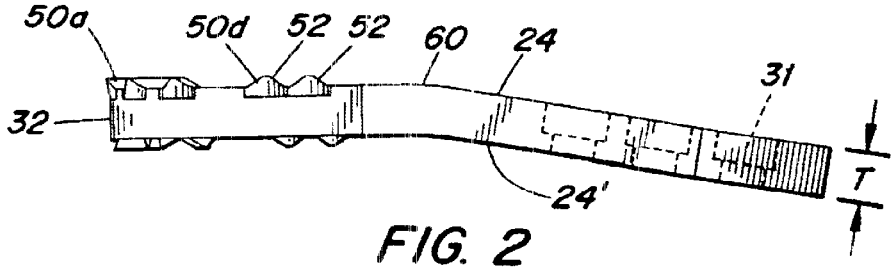
FIG. 2 is a side elevational view of the drill bit depicted in FIG. 1.

Depicted in FIGS. 1 and 2 is a drill bit 20 for trenchless drilling which comprises a generally flat bit body 22 having first and second side surfaces 24, 24' separated from one another by a thickness T of the bit body. The bit body includes a front cutting end 28, and a rear mounting end 30 adapted to be mounted to a rotary drill string (e.g., by bolts extending through holes 31 formed in the bit body). The bit body defines a longitudinal center axis X—X extending through the mounting and the cutting end.

Figure 4:
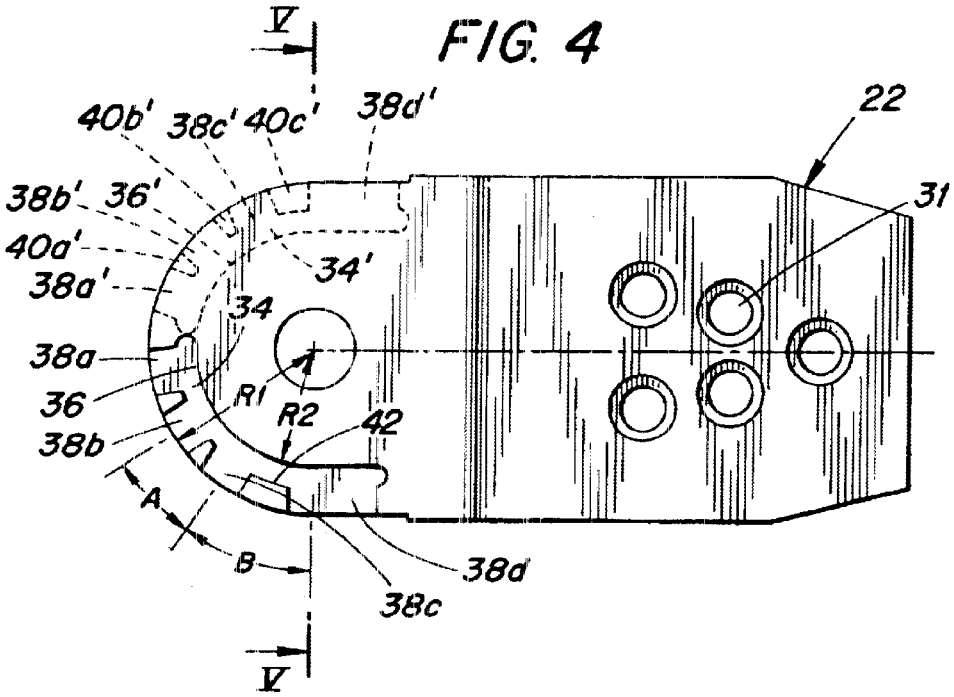
FIG. 4 is a top plan view of a bit body of the drill bit prior to the mounting of cutting teeth therein.
Figure 6:
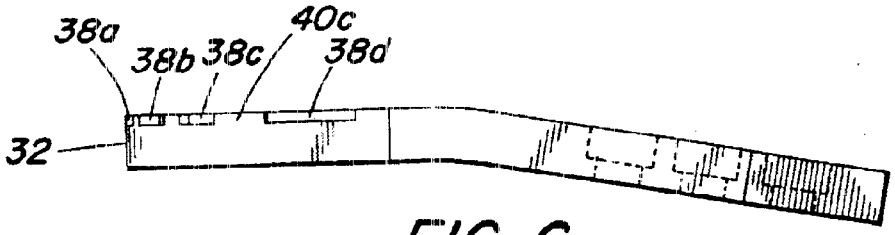
FIG. 6 is a side elevational view of the bit body depicted in FIG. 4.

The cutting end includes a convexly curved, forwardly facing front edge 32. First and second grooves 34, 34' are formed in the first and second side surfaces 24, 24', respectively. Each grooves defines a forwardly facing convexly curved shoulder 36, 36' spaced rearwardly from the front edge (see FIG. 4). Each shoulder 36, 36' is exposed to the front edge 32 by a set of slots 38*a*, 38*b*, 38*c*, 38*d*, or 38*a*', 38*b*', 38*c*', 38*d*' formed in the respective first and second side surfaces 24, 24' (see FIG. 4). Each slot extends from the front edge 32 to a respective groove 34, 34' in a direction oriented generally radially with reference to the front edge, i.e., perpendicular to a line extending tangentially to the front edge. The front edge preferably comprises a segment of a circle, i.e., is defined by a radius of curvature R1, and each shoulder 36, 36' is preferably defined by a second (shorter) radius of curvature R2. The radii R1, R2 share a common center, so the curvatures thereof correspond to one another.

Figure 5:
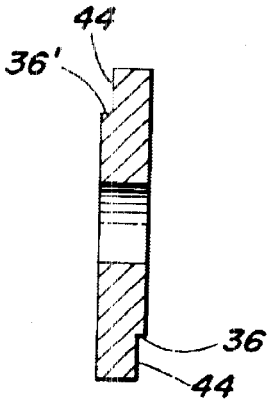
FIG. 5 is a sectional view taken along the line V—V in FIG. 4.

The slots 38*a*–38*d*, or 38*a*'–38*d*' associated with each groove 34, 34' are spaced apart from one another along the front edge by lands 40*a*, 40*b*, 40*c* (FIG. 1), or 40*a*', 40*b*', 40*c*' (FIG. 4), formed by the bit body. Each land includes a rear end 42 facing, and spaced forwardly from, a respective shoulder 36 or 36'. The grooves and slots extend only partially through the thickness of the bit body from the respective first and second side surfaces 24, 24', so that the bit body defines a floor 44 extending from each shoulder 36, 36' to the front edge (see FIG. 5).

First and second sets of cutting teeth 50*a*, 50*b*, 50*c*, 50*d*, 50*e* or 50*a*', 50*b*', 50*c*', 50*d*', 50*e*' are mounted to respective ones of the first and second side surfaces 24, 24'. The first set of teeth 50*a*–50*e* is disposed on one side of the axis X—X, and the second set of teeth 50*a*'–50*e*' is disposed on the other side of the axis X—X (see FIG. 1). Each tooth preferably comprises a single piece of material (preferably tungsten carbide) that is harder than the material of the bit body 22 (preferably steel).

Figure 3:
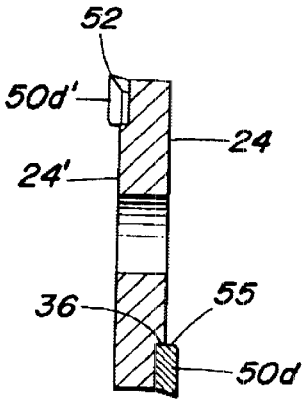
FIG. 3 is a sectional view taken along the line III—III of FIG. 1.

Each tooth includes a front cutting end projecting past the front edge 32, and a rear mounting portion brazed in a respective one of the slots. The mounting portion rests upon the floor 44, and a rearwardly facing end 55 of each tooth abuts against a respective one of the shoulders 36 or 36' (See FIG. 3). Preferably, each tooth engages at least one adjacent tooth at a location adjacent the rearwardly facing end.

Three of the slots 38*a*–38*c*, or 38*a*'–38*c*', of each set of slots are spaced apart by the same angle A (e.g., 23°). The teeth 50*a*–50*c* or 50*a*'–50*c*', associated with those slots extend at respective acute angles with the axis X—X, the angle which is formed by the tooth 50*b* (or 50*b*') being larger than the angle formed by the tooth 50*a* (or 50*a*'); and the angle which is formed by the tooth 50*c* (or 50*c*') being larger than the angle formed by the tooth 50*b* (or 50*b*').

The tooth 50*d* (or 50*d*') forms an angle B with the tooth 50*c* (or 50*c*') which is larger than the angle A, e.g., the angle B could be 35°.

The teeth 50*d* and 50*e* (50*d*' and 50*e*') extend substantially parallel to each other and perpendicular to the axis.

The teeth can have any suitable configuration, but preferably each tooth has a cutting edge 52 that comes to a point at the middle thereof (see FIG. 2).

The first set of slots 38*a*–38*d* is arranged asymmetrically relative to the second set of slots 38*a*'–38*d*' considered with reference to the axis X—X. That is, the angle formed between the tooth 50*a* and the axis X—X is smaller than the corresponding angle formed by the tooth 50*a*'. The angle formed between the tooth 50*a*' and the axis is smaller than the angle formed between the tooth 50*b* and the axis, and so on. Thus, during rotation of the bit about the axis X—X, the tooth 50*a*' does not track the tooth 50*a*; the tooth 50*b*' does not track the tooth 50*b*, and so on.

The bit body, while being generally flat, is preferably bent slightly at a location 60 located rearwardly of the grooves 34, 34' so that the cutting end 28 is inclined relative to the mounting end 30 (see FIG. 2).

Figure 8:
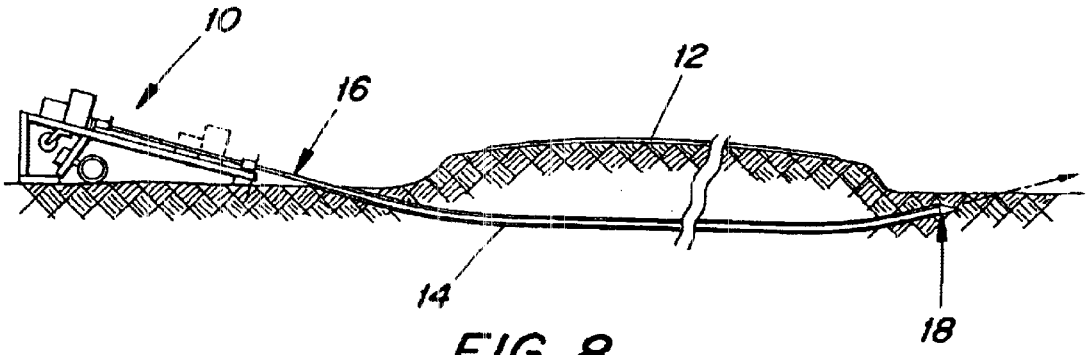
FIG. 8 (PRIOR ART)
FIG. 8 is a schematic depiction of a prior art trenchless drilling machine in operation.

The bit body includes a hole 62 in the cutting end in order to enable an object such as a conduit, cable, hole liner, etc., to be attached to the bit body after the bit body has completed drilling a hole (e.g., after the bit body "breaks through" the soil surface to the right of the roadway in FIG. 8). Then, when the drill string is pulled back through the hole, the object will also be pulled through.

When manufacturing the bit body 22, the grooves 34, 34' and the slots 38*a*–38*d* and 38*a*'–38*d* are machined by milling operations. In that regard, the grooves 34, 34' are milled by a separate milling step from the milling of the slots 38*a*–38*d* or 38*a*'–38*d*'.

Figure 7:
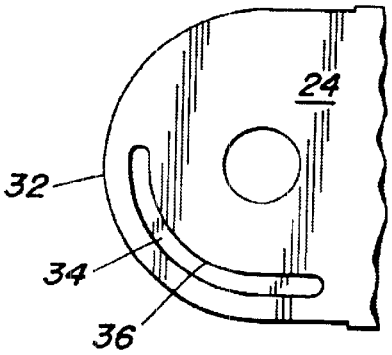
FIG. 7 is a fragmentary top plan view of a blank being formed into a bit body, the blank shown after a groove has been milled into a one side surface thereof, and before slots are milled into that side surface.

The grooves 34, 34' can be milled prior to, or after, the milling of the slots; the groove and slots of the first side surface 24 could be milled prior to the milling of the groove and slots of the second side surface 24'. FIG. 7 shows how the side surface 24 would appear if the groove 34 were milled in a steel blank prior to the milling of the slots 38*a*–38*d*.

If the grooves 34, 34' were not formed at all, i.e., if only slots were milled, then the rear wall of each slot would be concavely curved, due to the nature of milling. Thus, the flat rearwardly facing ends of the teeth would not be able to abut the rear wall of the respective slots. However, by forming the grooves 34, 34' in conjunction with the slots, the convex shoulders 36, 36' are formed in order to define walls that the rear ends of the teeth can effectively abut.

In use of the drill bit 20, the mounting end 30 of the bit is attached to the front end of a drill string, and the drill string and the drill bit are rotated together about the axis X—X. Thus, the carbide teeth 50*a*–50*e* and 50*a*'–50*e*' cut through soil, rock etc. as the drill string is advanced generally horizontally beneath a structure such as a roadway. As they cut, the backsides of the teeth are supported by the respective floors 44 of the bit body.

It will be appreciated that the drill bit can be economically manufactured because milling techniques can be employed to form the grooves and slots. The milling techniques are performed in such a way that the near ends of the teeth are effectively supported. That is, a groove 34 or 34' is formed in conjunction with slots 38*a*–38*d* or 38*a*'–38*d*' so that the rear ends of the teeth are able to abut a shoulder of the grooves 34, 34'. Moreover, the teeth can be formed entirely of carbide (in lieu of being formed of a carbide/steel composite as in the prior art) since the teeth can be reliably secured in the grooves and slots by means of brazing.

During a cutting operation, the teeth are supported from behind by the floors 44 which are produced as a result of the milling operations.

Although the front edge 32 is shown as being convexly curved, it could instead comprise two forwardly converging straight edge portions. In that case, the grooves 34, 34' could be straight instead of curved, and the shoulders 36, 36' could be oriented parallel to the respective straight edge portions.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A drill bit for trenchless drilling comprising:

a generally flat bit body including first and second side surfaces separated from one another by a thickness of the bit body, the bit body further including a front cutting end, and a rear mounting end adapted to be mounted to a rotary drill string, the bit body defining a longitudinal center axis extending through the mounting end and the cutting end;

the cutting end including a front edge, and first and second grooves formed in the first and second side surfaces, respectively, each groove defining a generally forwardly facing shoulder spaced rearwardly from the front edge and being exposed to the front edge by a plurality of slots formed in the respective first and second side surfaces, each slot extending from the front edge of a respective groove in a direction oriented generally radially with reference to the front edge, the slots associated with each groove being spaced apart from one another along the front edge by lands formed by the bit body, each land including a rear end spaced forwardly from and facing the respective shoulder, the grooves and the slots extending only partially through the thickness of the bit body from the respective first and second side surfaces, wherein the bit body defines a floor extending from each shoulder to the front edge; and first and second sets of cutting teeth mounted to respective ones of the first and second side surfaces and disposed on opposite sides of the axis, each tooth including a front cutting end, and a rear mounting portion mounted in a respective one of the slots, wherein each mounting portion rests upon the floor associated with the respective slot, and a rear end of each tooth abuts against a respective one of the shoulders, the first set of teeth being arranged asymmetrically relative to the second set of teeth with reference to the axis.

2. The drill bit according to claim 1, wherein each tooth comprises a carbide body, with a carbide surface of each carbide body brazed directly to the bit body.

3. The drill bit according to claim 1 wherein the front edge is convexly curved, and the shoulder is convexly curved correspondingly to the curvature of the front edge.

4. The drill bit according to claim 3, wherein the front edge is defined by a first radius of curvature, and each of the shoulders is defined by a second radius of curvature, the first and second radii of curvature having a common center of rotation as viewed in a direction perpendicular to the side surfaces, the common center of rotation lying on the axis.

5. The drill bit according to claim 1, wherein the bit body is bent at a location disposed rearwardly of the grooves, wherein the cutting end is inclined relative to the mounting end.

6. The drill bit according to claim 1 wherein some of the teeth of each of the first and second sets form an acute angle with the axis, and at least one tooth of each set forms a ninety degree angle with the axis.

7. The drill bit according to claim 1 wherein at least two teeth of each set engage one another adjacent their rearwardly facing ends.

* * * * *